US011491612B2

(12) United States Patent
Parra

(10) Patent No.: US 11,491,612 B2
(45) **Date of Patent: *Nov. 8, 2022**

(54) ARMORER TOOL SYSTEM FOR ASSEMBLY AND SERVICING AR PLATFORM FIREARMS

(71) Applicant: Jorge Augusto Parra, Johns Creek, GA (US)

(72) Inventor: Jorge Augusto Parra, Johns Creek, GA (US)

( * ) Notice: Subject to any disclaimer, the term of this patent is extended or adjusted under 35 U.S.C. 154(b) by 339 days.

This patent is subject to a terminal disclaimer.

(21) Appl. No.: 16/658,100

(22) Filed: Oct. 20, 2019

(65) Prior Publication Data

US 2021/0114174 A1 Apr. 22, 2021

(51) Int. Cl.

| | |
|---|---|
| ***B25B 1/00*** | (2006.01) |
| ***B25B 1/24*** | (2006.01) |
| ***F41A 11/00*** | (2006.01) |
| ***F41A 21/48*** | (2006.01) |

(52) U.S. Cl.
CPC ..... *B25B 1/2463* (2013.01); *F41A 11/00* (2013.01); *F41A 21/48* (2013.01)

(58) Field of Classification Search
CPC ..... F41C 27/00; F41A 11/00; F41A 21/48; B25B 1/2463
See application file for complete search history.

(56) References Cited

U.S. PATENT DOCUMENTS

| | | | | |
|---|---|---|---|---|
| 9,372,041 | B1 | 6/2016 | Geissele | |
| 9,849,566 | B2 | 12/2017 | Bennett | |
| 10,670,374 | B2 * | 6/2020 | Storch | F41G 11/003 |
| 10,739,101 | B2 * | 8/2020 | Jacobson | F41A 35/00 |
| 2019/0086183 | A1 * | 3/2019 | Christy | F41C 27/00 |
| 2020/0370853 | A1 * | 11/2020 | Jacobson | F41A 23/18 |

* cited by examiner

*Primary Examiner* — Steven O Douglas

(57) ABSTRACT

An armorer tool system for distributing the applied torque over a very wide surface, associated with assembling and disassembling primarily the barrel and the lower receiver extension of an AR platform firearms, independently of the specifications of their barrel extension, lower receiver and upper receiver external features, and magazine well geometry; and methods of using the tools are also disclosed.

11 Claims, 12 Drawing Sheets

ARMORER TOOL SYSTEM FOR ASSEMBLY AND SERVICING AR PLATFORM FIREARMS

CONTINUING APPLICATION

Ser. No. 16/252,639 Application Date: Jan. 20, 2019

FIELD

The field relates to gunsmithing and, more specifically, to tools for assembly and disassembly of firearms and methods for their use.

Classification: B25B-B25B 27/00

Keywords: armorer, gunsmith, tool, block, support, mount, firearm

REFERENCES OF RELATED ART

U.S. Pat. No. 9,849,566 B2 Dec. 26, 2017, William Bradley Bennet and others

U.S. Pat. No. 9,523,035 B2 Nov. 21, 2017, William H. Geissele and others

U.S. Pat. No. 9,372,041 B1 Jun. 21, 2016, William H. Geissele and others

BACKGROUND OF THE INVENTION

A typical AR platform long-barreled firearm, see FIG. 6, is comprised by the upper receiver (1) and the lower receiver (2), refer to FIGS. 6, 7, and 8. Note: In all figures, each notable part has the same identifier number.

The upper receiver configures the upper front end of the weapon and attaches the barrel (3), barrel nut (4), the gas system (not shown in the figures), the muzzle brake or flash hider (5), the modular handguard (6), the sight system that can be iron sights, a red dot or magnified scope (7), the charging handle (8), and an optional foregrip (9). The barrel is attached to the upper receiver with the barrel nut (4), see FIG. 2. The lower receiver configures the lower and rear of the firearm, see FIG. 6, housing the trigger system (10) and other internal parts, the grip (11), the magazine magwell (12), the magazine (13) and the rear end of the firearm consisting of the receiver extension or buffer tube (14), the buttstock (15), castle nut (17), and end plate (18). The lower receiver extension is attached to the lower receiver with the castle nut (17) nut and a washer with an oblong profile called the receiver end plate (18) that can be used to attach the sling. See FIG. 8.

The bolt carrier group (BCG) (16) and the buffer (not shown in the drawings) travel back and forth along the upper receiver cylindrical well (19), see FIGS. 6 and 7, and the lower receiver extension or buffer tube (14), to handle the insertion and extraction of the rounds to be fire, as well, as the locking of the bullet in the chamber to withstand the explosion of the powder while the bullet is ejected forward. Using a portion of the expanding gas, using a variety of methods, that pushes the bullet to a target the BCG moves to the back against a buffer spring (not shown in the drawings), see FIG. 6, located inside the receiver extension (14), which in turns stores enough energy to send back the BCG forward. The BCG can't rotate during the movement because the gas key, shown hidden inside the charging handle (8) in the FIG. 7, travels along a substantially rectangular well created inside the charging handle (8) that in turns rests in the upper receiver charging handle well (20), doing this, a very reliable chamber is created, the bolt (21) alone is able to rotate to axially locking its lugs with the corresponding lugs of the barrel extension by the action of the cam-pin (not shown in the figures).

A description of the firearm barrel is necessary to clearly understand this assembly, the barrel always comes assembled with the barrel extension from the factory, through a thread, the barrel extension is tightened and pinned against the barrel itself, to the naked eye the barrel is one piece, the barrel nut (4) holds the barrel extension securely against the upper receiver (1), therefore the barrel (3) to the upper receiver (1).

In the firearm AR platform, installing or removing the barrel to the upper receiver to perform initial assembly, maintenance, parts replacement, or adjustment requires the application of torque to the barrel nut (4). Also, the application of torque is needed to perform similar operations with parts like the flash hider or muzzle brake (5). See FIGS. 2 and 3.

Also, torque is required to tighten the castle nut (17) to assemble the lower receiver (2) to the receiver extension or buffer tube (14). Currently, in the market, there are two variants for the receiver extension: the MILSPEC and the Commercial both can be used with the lower receivers for the AR-15 or the AR-10. See FIGS. 5 and 10.

One common problem associated with removal and mounting of such firearm parts and related components is for the torque applied during the removal or mounting actions to be transferred to other parts of the firearm with unwanted consequences like:

- Damage due to stress concentration particularly on small firearms parts or their counterparts
- Damage due to high stress on the tool itself based only on polymer
- Instability of the assembly support, potential breaking and accident occurrence
- The impossibility of disassembly due to marring of the parts, particularly the barrel nut, therefore, there is the need to apply excessive torque to disassemble the parts without damaging the firearm In another aspect of the art, currently most of the tools available are:

- Barrel Extension specific limiting their use to a single barrel extension, for example, NATO 556, 223, 223-Wylde or Winchester 308
- Upper or Lower Receiver externals specific; there are vise blocks that hold together the receiver using a bench vise, per their nature, they are capable of fitting only to the externals of a given variety of upper and lower receivers, like the AR-15 forged MIL standard
- Magazine Well specification specific; there are vise blocks introduced in the magazine well can hold the lower receiver by a bench vise, per their nature, limiting the tool to lower receivers with a specific type and caliber magazine well, for example, the NATO 556 or 223 standard magazines.

On the other hand, the current art accumulated cost of several tools necessary to cover most of the receivers available is only afforded by the professional gunsmith and the manufacturers themselves.

The popularity of the light recoil, reliable and accurate AR-15 and AR-10 platforms is unmatched. Since the original patent expired about 1980, the civilian model began to be mass produced by a variety of companies. The market took notice of its modular construction and soon new bullet calibers and configurations appeared to satisfied shooters all over America and the world. Today, in America an owner can have one lower receiver with multiple uppers, each configured for a different use, one strictly for plinking and fun, another for hunting deer, one for varmints or predators, one for self-defense, another for long range shooting competition, other for training, and even one chambered for the .22 Long Rifle cartridge or a 9 mm pistol round. This incredible versatility is the beauty of the AR platform allowing to personalize the rifle to suit the most demanding needs and tastes.

The AR rifle can be purchased as a fully assembled package, a gun kit, pre-assembled components, or even individual parts from a wide selection of aftermarket options.

Assembling near to 50 parts of a complete rifle is relatively easy. There are only two operations that are somehow demanding, they are the tightening of the barrel nut (4) and the castle nut (17), with a recommended torque, for assembly or otherwise releasing same parts for disassembling; they are the subject of the use of tools described in this patent.

The AR-15 and the AR-10 receivers share most of the functional features, the upper receiver of the AR-10 platform has larger overall dimensions than the AR-15, the bolt carrier well has a bigger diameter and it is longer than the AR-15 counterpart to accommodate the larger dimensions of the AR-10 bolt carrier group.

Also, the AR-10 and AR-15 lower receivers (2) share most of the functional features and use the same thread specification to receive the lower receiver extension (14). Although, there are two versions of receiver extensions compatible to both the AR-15 and the AR-10: the MIL-SPEC version and the Commercial version, the main difference between them is the choice of raw materials and the manufacturing processes that make the outside diameter and some externals features are slightly different.

SUMMARY OF THE INVENTION

In general terms, this disclosure is directed to armorer tools for distributing the torque associated with assembling and disassembling components of a firearm of the AR-15 and AR-10 platforms over a very wide surface. The two tools of the system disclosed in this patent attached to a bench vise would safely support the AR upper receiver (1) to tighten the barrel nut (4) to assemble the barrel (3) with the AR upper receiver, and the lower receiver extension (14) also called the buffer tube, to tighten the castle nut (17) to assemble the buffer tube with the lower receiver (2).

On the other hand, the tool system subject of this patent supports the whole range of AR platform configurations, and available parts in the market, reducing the need to have multiple tools making it more affordable to a wider range of professional armorers and DIY enthusiasts, and making possible to use a wider range of bullet specifications and calibers since they are barrel extension and magazine well geometry independent. Furthermore, they can be used with a wider selection of upper and lower receiver styles because they are independent of the external features of the receivers themselves.

The AR Armorer Tool System disclosed herein consists of two embodiments: The upper receiver support tool and the lower receiver extension support tool.

First Embodiment

The upper receiver support tool, disclosed herein, is comprised by a bar having a substantially rectangular section (30) with a lengthwise recess in the front end (31) for the AR-15 and a wide rear end (32) for the AR-10. Small filling blocks (37) with a profile matching the AR-15 bolt carrier well are attached to the plate on the tool's front narrow end or large filling blocks (38) with a profile matching the AR-10 bolt carrier well attached on the tool's wide rear end.

The first embodiment is meant to tighten the barrel nut (4) and to be securely held by a bench press (50) to assemble the barrel (3) with the upper receiver (1) of the firearm. The upper receiver support tool can be used to hold both AR-15 and AR-10 upper receivers, as disclosed herein, configuring one end exclusively with the blocks matching the corresponding upper receiver type. See FIGS. 1, 2 and 3.

Also, the upper receiver support tool can be used to tighten the muzzle brake or flash hider (5) against the barrel or to a counter nut used for the same purpose.

Second Embodiment

The lower receiver extension support tool, disclosed herein, is meant to tighten the castle nut (17) to assemble the lower receiver (2) with the lower receiver extension or buffer tube (14), the tool is capable to support both the MIL-SPEC and COMMERCIAL receiver extension versions.

The lower receiver extension support tool is comprised of two symmetrical blocks that when tightened together against the receiver extension by a bench vise are capable to hold the assembly securely to tighten the castle nut (17). See FIGS. 4 and 5.

By its nature, it is independent of the magwell specification and the receiver externals features and size, making possible to be used with all receivers in the market.

Also, the lower receiver support tool can be used as an aid to install or remove most of the receiver internal parts.

DETAILED DESCRIPTION OF THE INVENTION

First Embodiment

Figure 1:
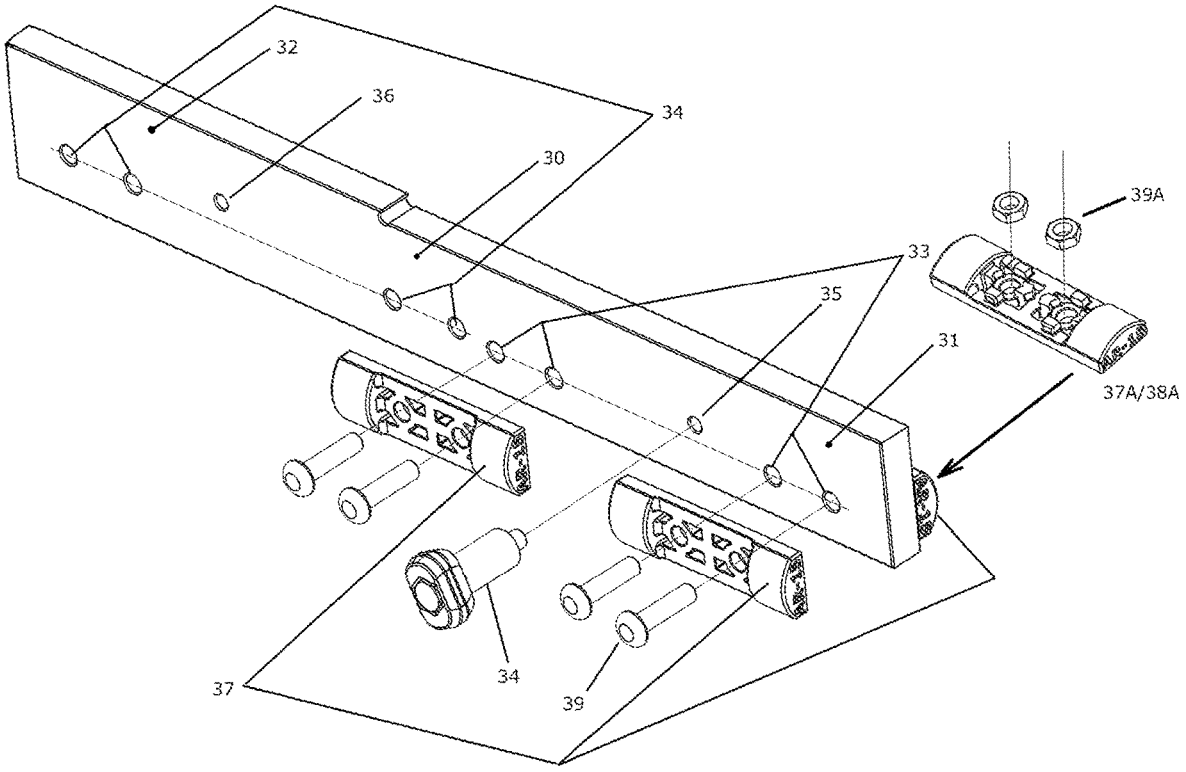
FIG. 1: Upper Receiver support tool parts.

The First Embodiment of an armorer tool system, the upper receiver support tool, disclosed herein, is for the assembly primarily of the barrel and the upper receiver of the firearm, and secondary for the installation of the gas block, muzzle brake or flash hider and handguard, (each notable part has the same identifier number, refer to FIGS. 1, 2, 3, 6 and 7) comprising:

A flat elongated member (30) with a substantially rectangular section comprising a front portion (31) and a rear portion (32). See FIG. 1.

The elongated member narrowest side has a constant width to match the charging handle well width (20) that is the same for both the AR-15 and the AR-10 upper receivers The front portion (31) is recessed longitudinally to match the smaller height of bolt carrier/carrying handle well (19 and 20) of the AR-15 upper receiver, the elongated member widest side has four perpendicular through holes (33) configured to attach two blocks (37) on each side to match the AR-15 upper receiver bolt carrier group (BCG) well (19) and one perpendicular threaded hole (35) to attach a threaded pin to secure the upper receiver to the tool (34).

The rear portion (32), without a recess, matches the height of the AR-10 bolt carrier group/carrying handle well (19 and 20), the elongated member widest side has four perpendicular through holes (34) configured to attach two bigger blocks (38) on each side to match the AR-10 upper receiver bolt carrier well (19) of the AR-10 upper receiver and one perpendicular threaded hole (36) to attach a threaded pin to secure the upper receiver to the tool (34).

The First Embodiment of the armorer tool system, disclosed herein, is meant to use the bolt carrier group and the charging handle wells (19 and 20), this is to use the internal features of the upper receiver to support the assembly. There are several tool configurations that can achieve this goal, for example, a couple of round bars with an integral or detachable key.

Figure 2:
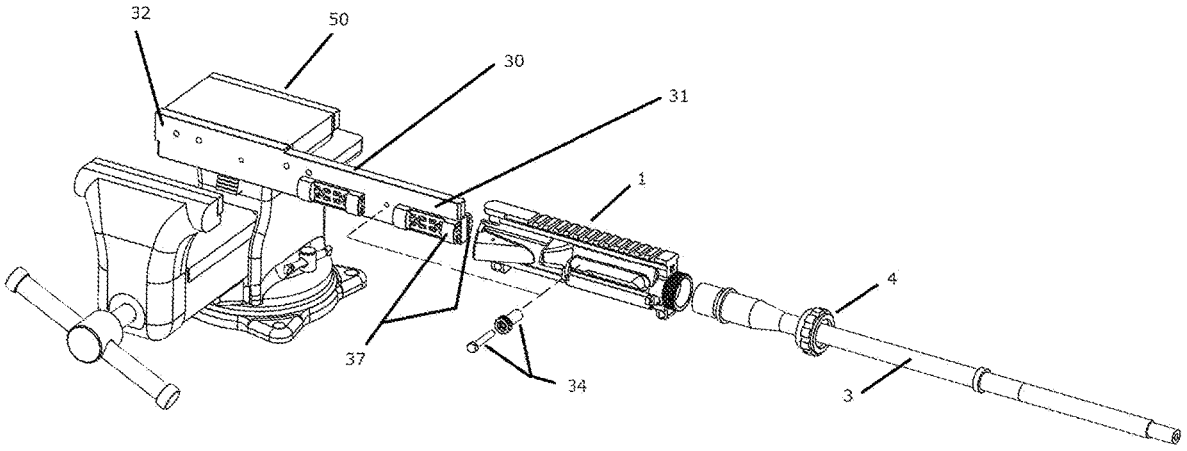
FIG. 2: Upper Receiver support tool primary function to assemble the upper receiver with barrel.
Figure 3:
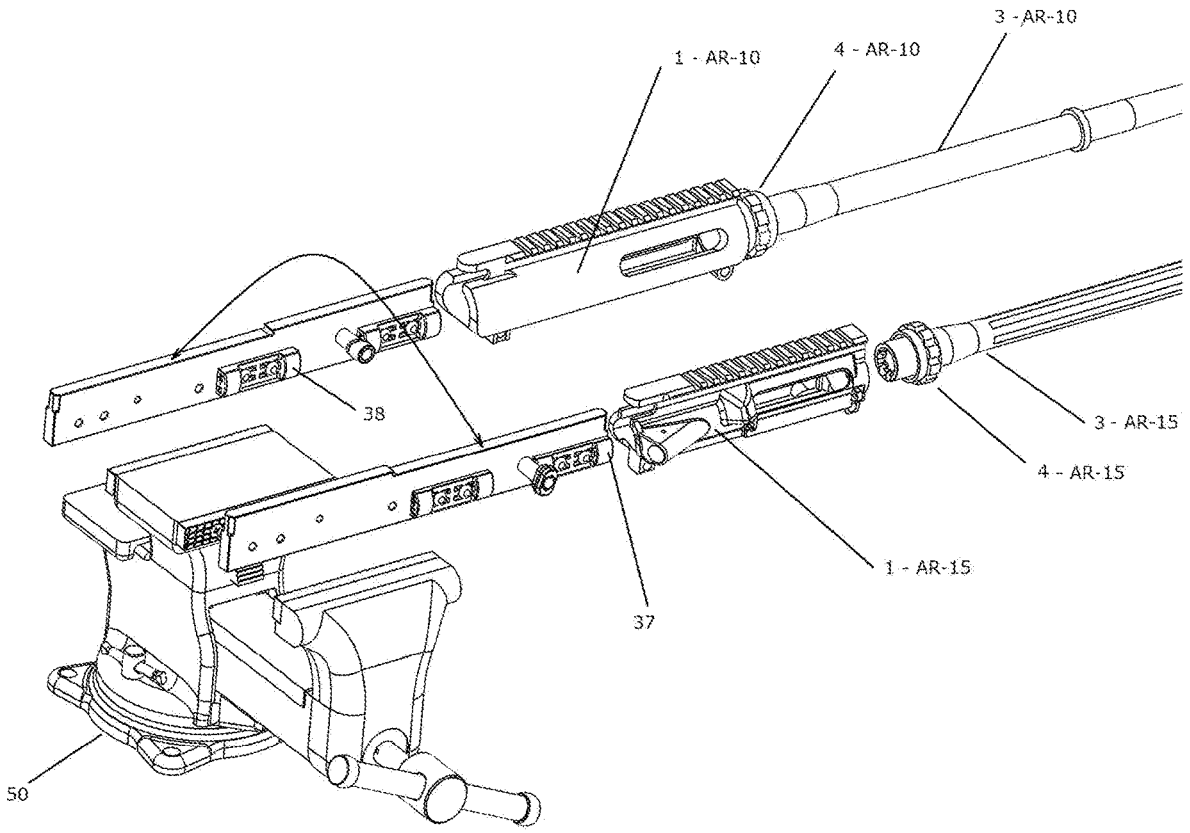
FIG. 3: Upper Receiver support tool configuration with exclusive options.
Figure 7:
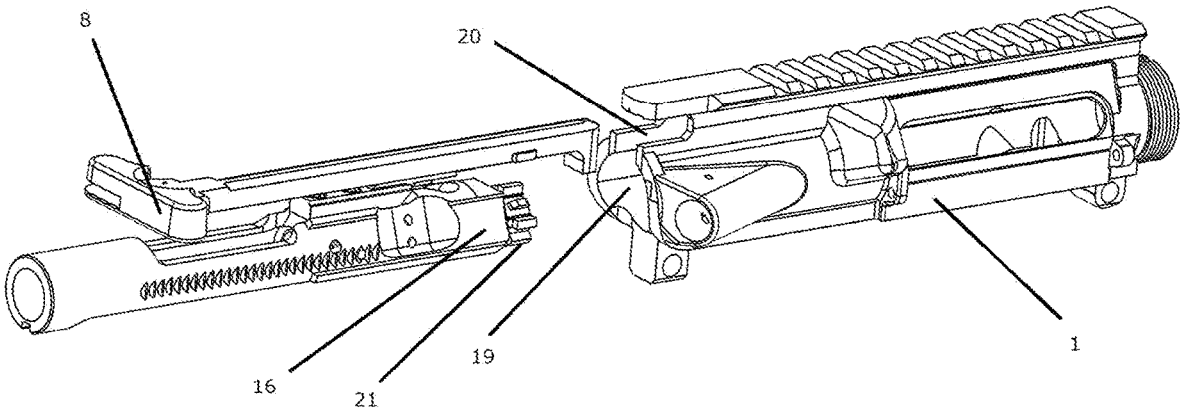
FIG. 7: AR-15/10 upper receivers, charging handles and bolt carrier groups details.

The selected configuration disclosed herein comprises a rectangular bar or elongated member, it has the positions of the blocks' holes on the bar configured such that the cylindrical sides of the blocks (37 and 38) when installing on the bar, are substantially concentric with the corresponding bolt carrier group well (19), see FIGS. 2, 3 and 7. The distance between holes of the bolt carrier well blocks of each type of upper receivers is different to avoid errors during the configuration and use of the tool, being 20 mm for the AR-15 (37) and 22 mm for the AR-10 (38). This distance will be used to clearly sort the bolt carrier well blocks cylindrical radius that is set to match the diameter of the corresponding bolt carriers: Approximately 25 mm of the AR-15 and the 30 mm of the AR-10. The blocks on one side (37A and 38A) are fitted with a convenient nut anti-rotation feature (39A) to eliminate the need to use a secondary wrench when installing the blocks on the elongated member.

In another aspect of the art, the First Embodiment of the armorer tool system, wherein by its nature, is independent from barrel extension making possible to be used with any type and caliber of barrel extension specification, and independent from the features and specifications of the externals of the upper receiver making possible to be used with any style, including custom upper receivers.

The First Embodiment of an armorer tool system, wherein the elongated member material is high strength aluminum or steel, the blocks material can be metallic, polymer or other suitable material. The manufacturing is a combination of sawing, machining, die cutting, drilling, tapping, forge, extrusion, injection molding, 3D-Printing or another suitable method.

Barrel Nut Tightening Method

The First Embodiment of an armorer tool system, wherein is configured to be used with AR-15 upper receivers attaching only the AR-15 bolt carrier group well blocks to the front end of the tool (37), two on each side, the corresponding blocks for the AR-10 receiver (38) are to be removed from the assembly. The rear end is to be securely attached to a bench vise (50). See FIG. 2.

The First Embodiment of an armorer tool system, wherein is configured to be used with AR-10 upper receivers attaching only the AR-10 bolt carrier well blocks to the rear end of the tool (38), two on each side, the corresponding blocks for the AR-15 receiver are to be removed from the assembly (37). In this case, the front end is to be securely attached to a bench vise (50). See FIG. 3.

The First Embodiment of an armorer tool system, wherein the upper receiver (1) is slid over the armorer tool through the bolt carrier well until the tool touches the end of the charging well and it is secured attaching a threaded pin through the spent cartridge ejection port of the corresponding upper receiver (34). See FIGS. 3 and 10.

The First Embodiment of an armorer tool system, wherein the barrel of the firearm (3) is to be introduced into the upper receiver and then the barrel nut (4) is threaded into the upper receiver corresponding thread. Then torque is applied to the barrel nut, either for assembling or disassembling. The torque is distributed over a very large area along the charging handle well and the bolt carrier well blocks. The recommended magnitude of this torque is between 40-80 foot-pounds. Other parts like the Gas Block, Muzzle Brake or Flash Hider and Handguard can be subsequently installed. See FIGS. 2 and 3.

Acting Forces and Stress

Figure 9:
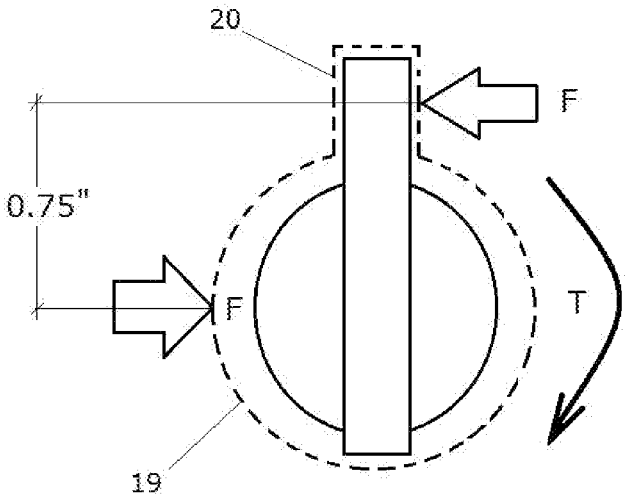
FIG. 9: Upper receiver support tool free body diagram.

The free body diagram in FIG. 9, shows the forces acting on the tool caused by a Torque acting on the barrel nut. If the torque magnitude is 120 lb-ft (50% above the max. recommended), the force can be calculated easily: $T=F\times D$, then $F=T/D$, in this case 120 lbs-ft/0.75 in*12 in/ft=1,920 lbs. The top force, shown in the figure, is smoothly distributed along the length of the receiver in contact with the elongated member, the bottom force is distributed on the blocks on one side of the elongated bar, that in turn, they transfer the force over the elongated bar itself. If the Yield Stress of the block is known, the required area of the blocks can be estimated. ABS polymer has a Compression Yield Strength of 9000 PSI, then the area can be easily calculated as: F=ABS-YS× Block-Area, then Required area becomes A=F/ABS-Yield, therefore 1,920 lbs/9,000 lbs/sq-in=0.21 sq-in., equivalent of a rectangular column of 0.30"×0.70". On each side of the elongated bar, there are two blocks each with a total of four times this area to extend the life and reliability of the tool distributing the torque along the receiver and achieving the best alignment possible.

From the receiver perspective, the required area is six times smaller since the bearing Yield Strength of aluminum is 56,000 PSI, the resulting force of 1,920 lbs. it is distributed along the length of the receiver 5.5 inches, and requiring only 0.04 sq-in. along the charging handle well (20).

Second Embodiment

Figure 4:
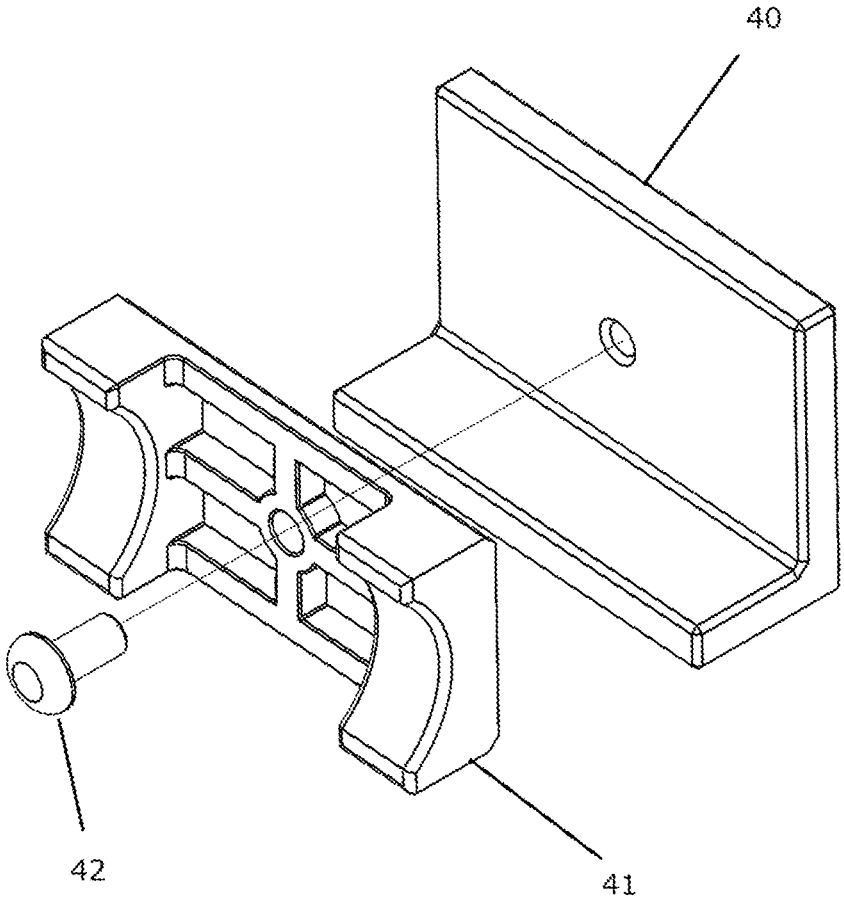
FIG. 4: Lower Receiver Extension support block parts.
Figure 8:
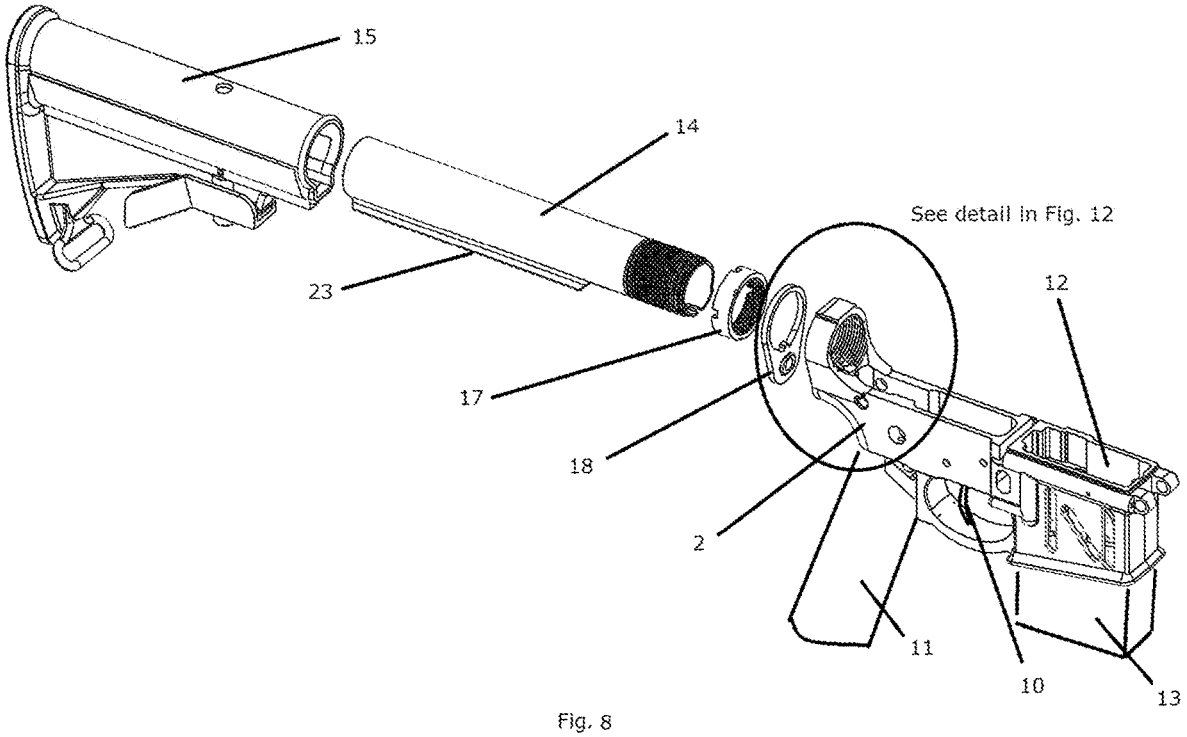
FIG. 8: AR-15/10 lower receiver, receiver extension, and buttstock details.

The Second Embodiment of an armorer tool system, disclosed herein, is primarily for the assembly of the lower receiver extension or buffer tube to the lower receiver of both the AR-15 and the AR-10 firearms. And, secondarily to safely hold the lower receiver to install or disassemble the magazine release, trigger system, safety and bolt release small parts comprising, see FIG. 4:

An angled member (40), with unequal sides, with a centrally located threaded hole on the longer side, configured to attach a block (41) that matches the profile of the lower receiver extension or buffer tube, the other side is recessed to match the width of the receiver extension buttstock length adjustment key (23), see FIG. 8. The angle and block lengths are 40 mm. The block is attached to the angle using a bolt (42), see FIG. 4.

Figure 5:
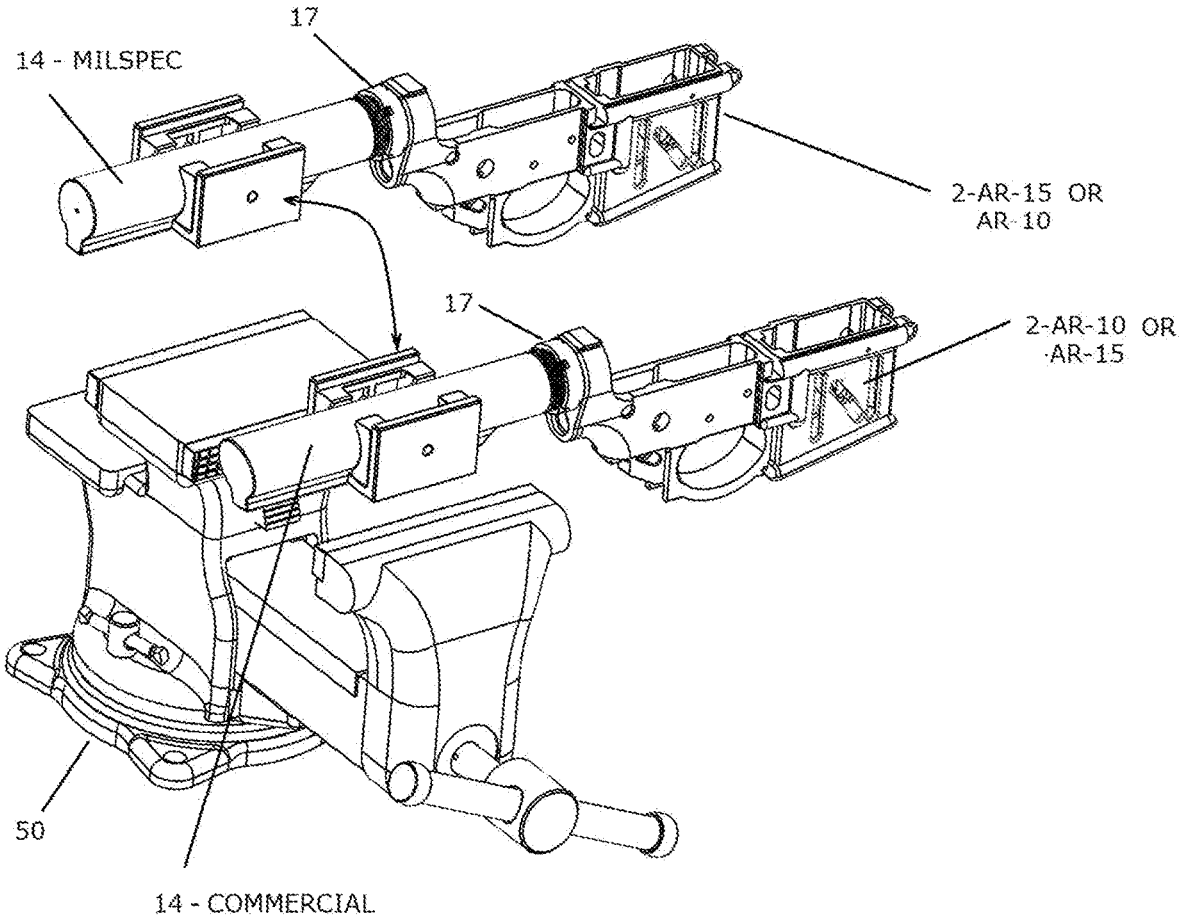
FIG. 5: Lower Receiver Extension support tool primary function and options.
Figure 6:
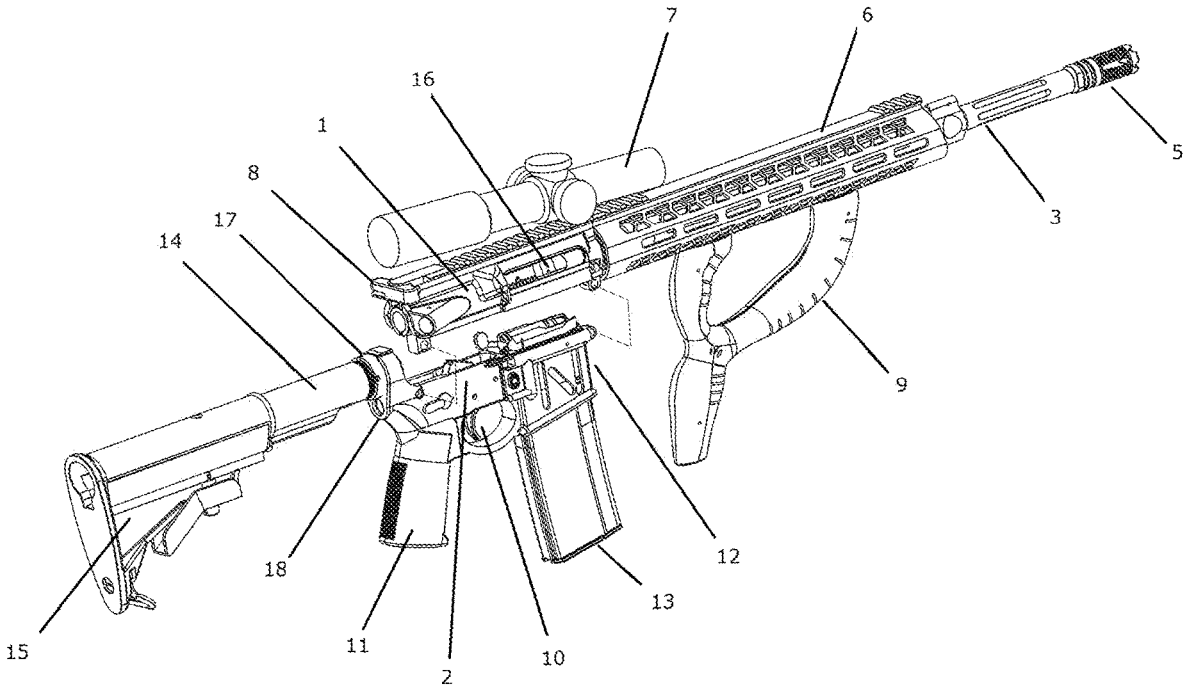
FIG. 6: AR-15/10 upper and lower receiver, outer portion illustration.

Two blocks as configure herein, located symmetrically on each side of the buffer tube are used to support the assembly on a bench vise (50). The longer side of the angles are used to rest the tool against the bench vise jaws and the angle recessed sides rest against the receiver extension key or buttstock length adjustment key (23), as shown in FIG. 5.

The Second Embodiment of an armorer tool system disclosed herein, is meant to use the lower receiver extension or buffer tube (14). Its purpose is to apply the available force in a bench vise jaw directly on the tool blocks, in turn, over the external features of the lower receiver extension to safely support the assembly; achieving a very simple, compact, light, safe, and effective support tool block set.

In another aspect of the art, the Second Embodiment of the armorer tool system, wherein by its nature, is independent from the magazine well geometry and, independent of the external specification of the lower receiver making possible to be used with lower receivers of any external features and magazine specification, size, caliber, shape, and form.

Figure 10:
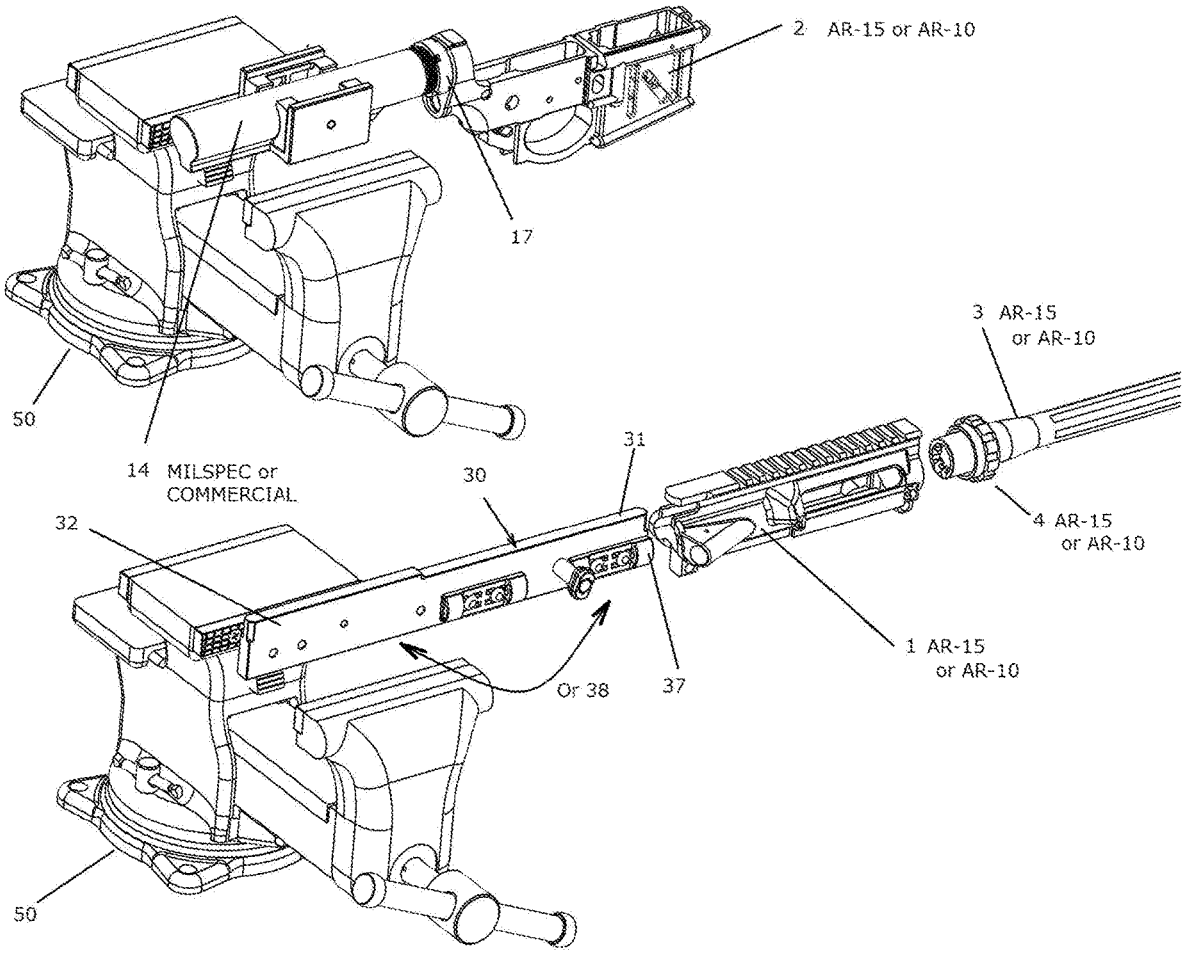
FIG. 10: Armorer Tools System for Assembly and Maintenance of all AR Platform firearms.

The Second embodiment of an armorer tool system wherein the lower receiver extension block is configured to match the two types of lower receiver extensions (14) the MIL-SPEC and the Commercial types. The block cylindrical radius and center position are set to match the diameter of 29.16 mm of the MIL-SPEC and the 29.68 mm of the Commercial types. FIGS. 5 and 10.

Figure 12:
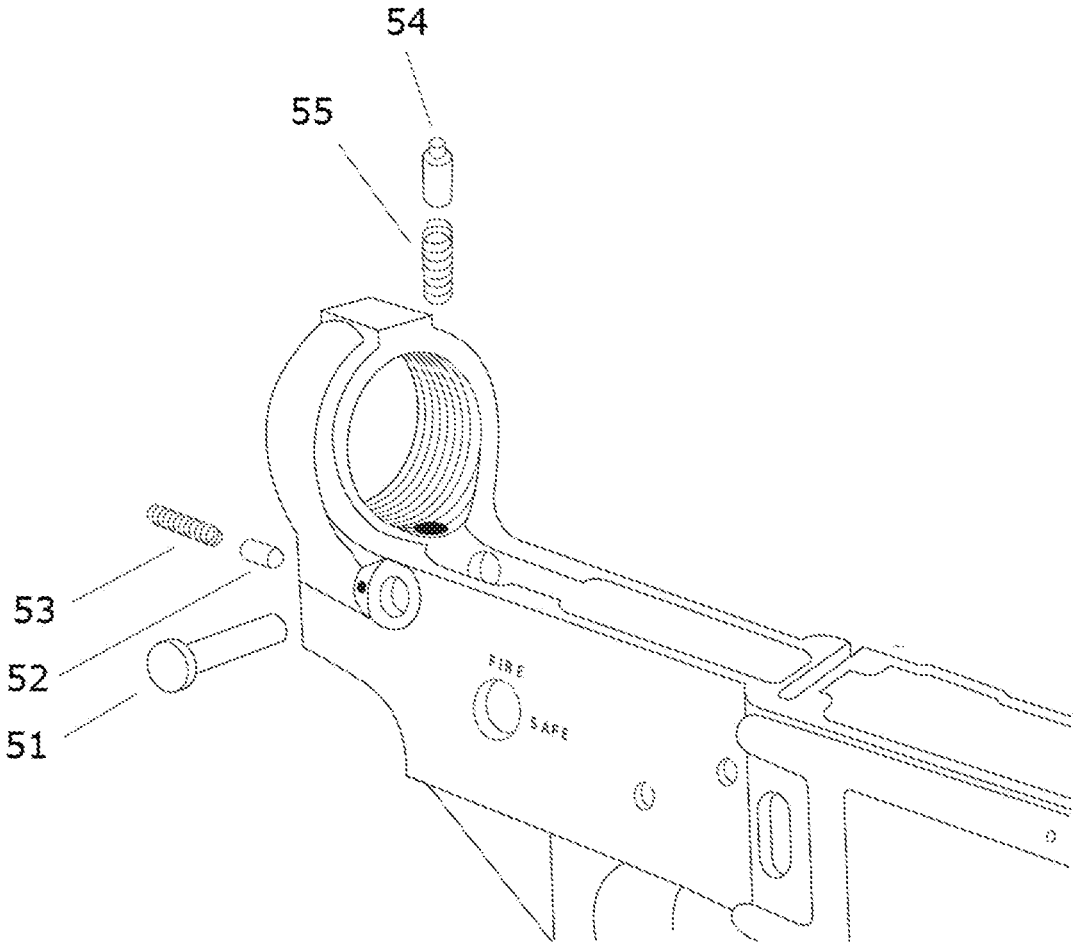
FIG. 12: Lower receiver parts to assemble with lower receiver extension or buffer tube.

Small parts related to this assembly must be already installed according to the recommendations of their respective manufacturers: The Takedown Pin (51), Takedown Pin Detent (52), Takedown Pin Detent Spring (53), Buffer Retainer Pin (54), and Buffer Retainer Pin Spring (55). See FIG. 12. The rest of the parts of the lower receiver can be installed or removed independently, before or after this assembly.

The Second embodiment of an armorer tool system wherein the angled member material is high strength aluminum or steel and the blocks material can be metallic, polymer or other suitable material. The manufacturing is a combination of sawing, die cutting, machining, drilling, tapping, forge, extrusion, injection molding, 3D-Printing or another suitable method.

Castle Nut Tightening Method

The Second embodiment of an armorer tool system, disclosed herein, is used to tighten or release the castle nut (17) that secures the receiver extension with the lower receiver, see FIG. 5. The receiver extension or buffer tube (14) is securely held by a bench vice (50), in between of the two tool blocks. The recommended magnitude of this torque is 40 foot-pounds. To maximize the lower receiver extension stability the tool should be located at the starting of the buttstock length adjustment key (23).

For cylindrical buffer receivers without the buttstock length adjustment key (23) will be necessary to apply extra force to keep the buffer tube stationary when the torque is applied. In this case, the user is responsible to avoid applying excessive force to permanently deform the buffer tube, particularly with skeletonized versions. Using a piece of sandpaper between the blocks and the buffer tube might add extra friction.

Figure 11:
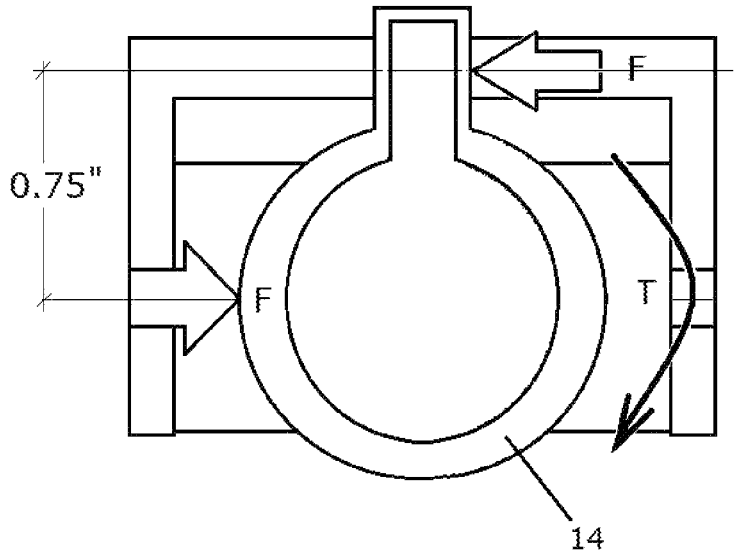
FIG. 11: Lower receiver extension support tool free body diagram.

Acting Forces and Stress The free body diagram in FIG. 11, shows the forces acting on the tool caused by a Torque acting on the castle nut. If the torque magnitude is 60 lb-ft (50% above the max. recommended), the force can be calculated easily: T=F×D, then F=T/D, in this case 60 lbs-in/0.75 in=800 lbs. The top force, shown in the figure, is smoothly distributed along the length of the receiver extension in contact with the angled member, the bottom force is distributed on the block on the other side of the receiver extension, that in turn, it transfers the force over the angle bar itself. If the Yield Stress of the block is known, the required area of the blocks can be estimated. ABS polymer has a Compression Yield Strength of 9000 PSI, then the area can be easily calculated as: F=ABS-YS×Block-Area, then Required area becomes A=F/ABS-Yield Stress, therefore 800 lbs/9,000 lbs/sq-in=0.09 sq-in., equivalent of a rectangular column of 0.13"×0.70". On each side of the buffer tube, there are two sections on the block each with a total of five times this area to extend the life and reliability of the tool distributing the torque along the receiver and achieving the best alignment possible.

From the receiver perspective, the required area is six times smaller since the bearing Yield strength of aluminum is 56,000 PSI, the resulting force of 800 lbs. it is distributed along the length of the receiver ~1.5 inches spreading the load requiring only 0.015 sq-in.

The invention claimed is:

1. An armorer tool, adapted to support an AR-15 or an AR-10 platform firearms upper receiver, configured to assemble, and disassemble primarily an upper receiver and a barrel comprising: a combination of a flat elongated bar, a plurality of AR-10 bolt carrier well blocks, a plurality of AR-15 bolt carrier well blocks and a locking pin;

the flat elongated bar comprises a substantially rectangular section having a constant width adapted to match a charging handle well width of the AR-15 or the AR-10 upper receivers, the flat elongated bar lengthwise outlines: a rear end portion having the height adapted to match a bolt carrier/charging handle well height of an AR-10 upper receiver, a front end portion with a height reduction adapted to match the corresponding height of an AR-15 bolt carrier group/charging handle well, and a middle portion connecting the rear end portion and the front end portion;

one set of four AR-10 bolt carrier well blocks configured to attach, two on each side, to the rear end portion of the flat elongated bar, each one comprising a circular segment section outlining a flat surface adapted to mate the flat elongated bar and a circular section adapted to mate concentrically the bolt carrier well of an AR-10 upper receiver, and one set of four AR-15 bolt carrier well blocks configured to attach, two on each side, to the front end portion of the flat elongated bar, each one comprising a circular segment section outlining a flat surface adapted to mate the flat elongated bar and a circular section adapted to mate concentrically to the bolt carrier well of an AR-15 upper receiver;

the flat elongated bar front end portion side has four perpendicular through holes configured to attach two blocks on each side to match an AR-15 upper receiver bolt carrier group (BCG) well;

the flat elongated bar rear end portion side has four perpendicular through holes configured to attach two blocks on each side to match an AR-10 upper receiver bolt carrier group (BCG) well;

one threaded hole perpendicular to the side of the flat elongated bar, located in the front end portion to attach a threaded pin to secure an AR-15 upper receiver to the tool mating through the spent brass ejection port of the upper receiver, configured to lock together the tool and the upper receiver when the armorer tool extends through the upper receiver and is mated to the barrel extension;

and one threaded hole perpendicular to the side of the flat elongated bar, located in the rear end portion to attach a threaded pin to secure an AR-10 upper receiver to the tool mating through the spent brass ejection port of the upper receiver, configured to lock together the tool and the upper receiver when the armorer tool extends through the upper receiver and is mated to the barrel extension.

2. The armorer tool of claim 1, wherein: the bolt carrier well blocks sets are located and held in place through holes on the flat elongated bar using two bolts and nuts.

3. The armorer tool of claim 2, wherein: the AR-10 bolt carrier well blocks holes distance is different to the AR-15 bolt carrier well blocks.

4. The armorer tool of claim 3, wherein: the armorer tool mates exclusively with the internal features of an upper receiver to support the upper receiver; the said internal features are the bolt carrier group well and the charging handle well; therefore, any applied torque on the barrel nut, while assembling or disassembling, is distributed over a very large area and safely locking and preventing relative rotation of the upper receiver and the armorer tool.

5. The armorer tool of claim 4, wherein: supports build and disassemble firearms of the AR-15 and AR-10 platforms with any type of barrel extension, bullet caliber and specification, magazine specification, and fitting most AR-10 and AR-15 forged, billet and custom upper receivers.

6. The armorer tool according to claim 5, wherein: the elongated bar material is constructed with high strength aluminum or steel.

7. The armorer tool according to claim 6, wherein the said bolt carrier well blocks material is constructed with metal, polymer, or reinforced composite.

8. A method to configure the armorer tool according to claim 7 to assemble or disassemble AR-10 upper receivers and barrels comprising the following steps:

attach only the AR-10 bolt carrier group well blocks to the rear end portion of the tool, two on each side, the corresponding blocks for the AR-15 receiver are to be removed from the tool;

the front end of the tool is to be securely attached to a bench vise.

9. A method to assemble the barrel to the AR-10 upper receiver using the configured armorer tool as per claim 8 comprising the following steps:

the AR-10 upper receiver is slid over the rear end portion of the armorer tool through the bolt carrier and charging handle well until the tool touches the end of the charging well;

secure the receiver to the tool attaching a locking pin through the spent cartridge ejection port;

introduce the barrel extension into the upper receiver aligning the barrel extension pin with the upper receiver pin slot;

thread the barrel nut into the upper receiver corresponding thread;

torque the barrel nut.

10. A method to configure the armorer tool according to claim 7 to assemble or disassemble AR-15 upper receivers comprising the following steps:

attach only the AR-15 bolt carrier group well blocks to the front end portion of the tool, two on each side, the corresponding blocks for the AR-10 receiver are to be removed from the tool;

the rear end portion of the tool is to be securely attached to a bench vise.

11. A method to assemble the barrel to the AR-15 upper receiver using the configured armorer tool as per claim 10 comprising the following steps:

the AR-15 upper receiver is slid over the front end portion of the armorer tool through the bolt carrier and charging handle well until the tool touches the end of the charging handle well;

secure the upper receiver to the tool attaching the locking pin through the spent cartridge ejection port;

introduce the barrel extension into the upper receiver aligning the barrel extension pin with the upper receiver pin slot;

thread the barrel nut into the upper receiver corresponding thread;

torque the barrel nut.

* * * * *